US008342070B2

(12) United States Patent
Travis

(10) Patent No.: US 8,342,070 B2
(45) Date of Patent: Jan. 1, 2013

(54) METHODS AND APPARATUS FOR A CONTROL SURFACE RESTRAINT AND RELEASE SYSTEM

(75) Inventor: Robert D. Travis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 616 days.

(21) Appl. No.: 12/237,338

(22) Filed: Sep. 24, 2008

(65) Prior Publication Data

US 2011/0072957 A1 Mar. 31, 2011

Related U.S. Application Data

(60) Provisional application No. 60/974,804, filed on Sep. 24, 2007.

(51) Int. Cl.
*F41F 3/052* (2006.01)

(52) U.S. Cl. ..... 89/1.806

(58) Field of Classification Search ..... 89/1.8, 89/1.808, 1.81, 1.819, 1.816, 1.59; 102/520, 102/526; 244/3.24, 3.25, 3.27
See application file for complete search history.

(56) References Cited

U.S. PATENT DOCUMENTS

| | | | | |
|---|---|---|---|---|
| 3,273,500 | A * | 9/1966 | Kongelbeck | 244/3.28 |
| 3,329,089 | A * | 7/1967 | Harrison | 102/377 |
| 3,392,629 | A | 7/1968 | Soderberg | |
| 3,769,876 | A * | 11/1973 | Haas et al. | 89/1.8 |
| 3,789,729 | A * | 2/1974 | Aupy | 89/1.8 |
| 3,921,498 | A * | 11/1975 | Kongelbeck | 89/1.8 |
| 4,666,105 | A * | 5/1987 | Dellinger et al. | 244/63 |
| 4,750,404 | A | 6/1988 | Dale | |
| 4,856,409 | A * | 8/1989 | Bowden | 89/1.819 |
| 5,220,125 | A | 6/1993 | Huber | |
| 6,250,584 | B1 | 6/2001 | Hsu et al. | |
| 6,314,886 | B1 * | 11/2001 | Kuhnle et al. | 244/3.28 |
| 7,182,013 | B1 * | 2/2007 | Hardo | 89/1.811 |
| 7,464,634 | B1 * | 12/2008 | Shah et al. | 89/1.8 |
| 2002/0073831 | A1 * | 6/2002 | MacLeon | 89/1.81 |
| 2004/0107826 | A1 | 6/2004 | Simmons | |
| 2006/0162535 | A1 * | 7/2006 | Yogev | 89/1.59 |
| 2008/0148927 | A1 * | 6/2008 | Alberding et al. | 89/1.817 |
| 2010/0269677 | A1 * | 10/2010 | Patel et al. | 89/1.819 |

OTHER PUBLICATIONS

The International Bureau of WIPO "International Preliminary Report on Patentability and Written Opinion of the International Searching Authority," mailed Apr. 1, 2010 for International Application No. PCT/US2008/077564 filed Sep. 24, 2008.

* cited by examiner

*Primary Examiner* — Michael Carone
*Assistant Examiner* — Reginald Tillman, Jr.
(74) *Attorney, Agent, or Firm* — Renner, Otto, Boisselle & Sklar, LLP

(57) ABSTRACT

In an embodiment of methods and apparatus for a control surface restraint and release system comprises a restraint apparatus detachably coupled to the control surface, a guidance rail slidably engaging the restraint apparatus, and a stopping mechanism coupled to the guidance rail and configured to stop a movement of the restraint apparatus.

19 Claims, 6 Drawing Sheets

METHODS AND APPARATUS FOR A CONTROL SURFACE RESTRAINT AND RELEASE SYSTEM

CROSS-REFERENCES TO RELATED APPLICATIONS

This application claims the benefit of U.S. Provisional Patent Application No. 60/974,804 filed Sep. 24, 2007, and incorporates the disclosure of that application by reference.

GOVERNMENT RIGHTS

The U.S. Government has a paid-up license in this invention and the right in limited circumstances to require the patent owner to license others on reasonable terms as provided for by the terms of N00024-03-C-6111 awarded by the U.S. Navy.

BACKGROUND OF INVENTION

Various missiles and other launchable systems may be stowed and/or transported in enclosures, such as canisters or boxes. Often times, the enclosure with the stowed missile is mounted on a launcher. While enclosures for missiles are necessary, contacts and/or collisions between the missile and the enclosure may damage the missile and/or the enclosure. To prevent damage to parts of the missile, such as a control fin, the enclosure may comprise a certain amount of space for clearance between the enclosure and the missile. Additionally, inadvertent missile rotation within the enclosure may result in mis-positioning of the missile and/or potential damage to the missile when the missile is launched from the enclosure.

SUMMARY OF THE INVENTION

Methods and apparatus for a restraint and release system according to various embodiments of the present invention comprise a restraint apparatus and a stopping mechanism for stopping the restraint apparatus. The restraint apparatus may be adapted to initially move with the projectile upon launch. The stopping mechanism may be configured to stop the restraint apparatus at a selected point, causing the release of the restraint apparatus from the control surface of the projectile.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

FIG. 3(*b*) representatively illustrates a restraint apparatus detachably coupled to a control surface and coupled to a projectile interface, according to the embodiment;

Elements and steps in the figures are illustrated for simplicity and clarity and have not necessarily been rendered according to any particular sequence. For example, steps that may be performed concurrently, sequentially, or in different order are illustrated in the figures to help to improve understanding of embodiments of the present invention.

DETAILED DESCRIPTION OF EXEMPLARY EMBODIMENTS

The following representative descriptions of the present invention generally relate to exemplary embodiments and the inventor's conception of the best mode, and are not intended to limit the applicability or configuration of the invention in any way. Instead, the following description is intended to provide convenient illustrations for implementing various embodiments of the invention. Changes may be made in the function and/or arrangement of any of the elements described in the disclosed exemplary embodiments without departing from the spirit and scope of the invention.

Figure 3A:
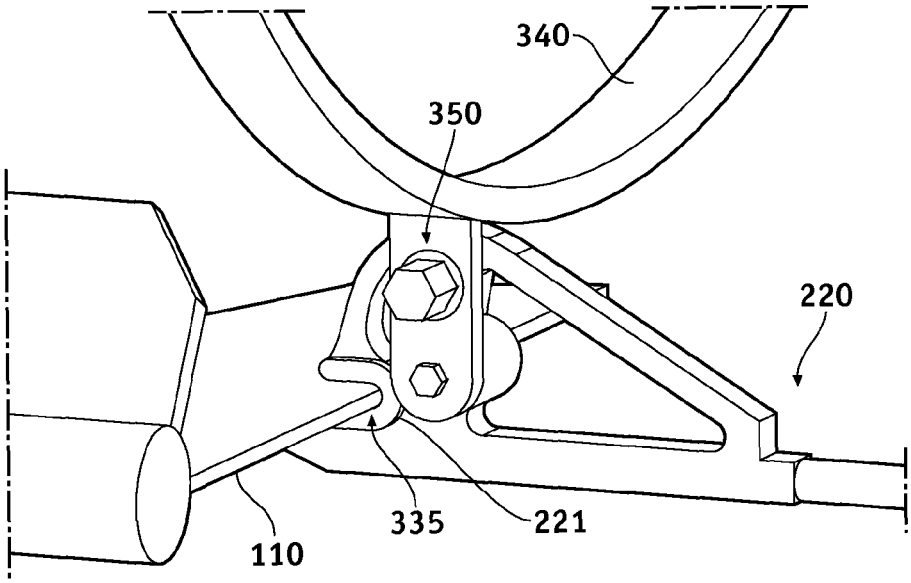
FIG. 3(*a*) representatively illustrates a restraint apparatus detachably coupled to a control surface and coupled to a projectile interface, according to the embodiment.
Figure 3B:
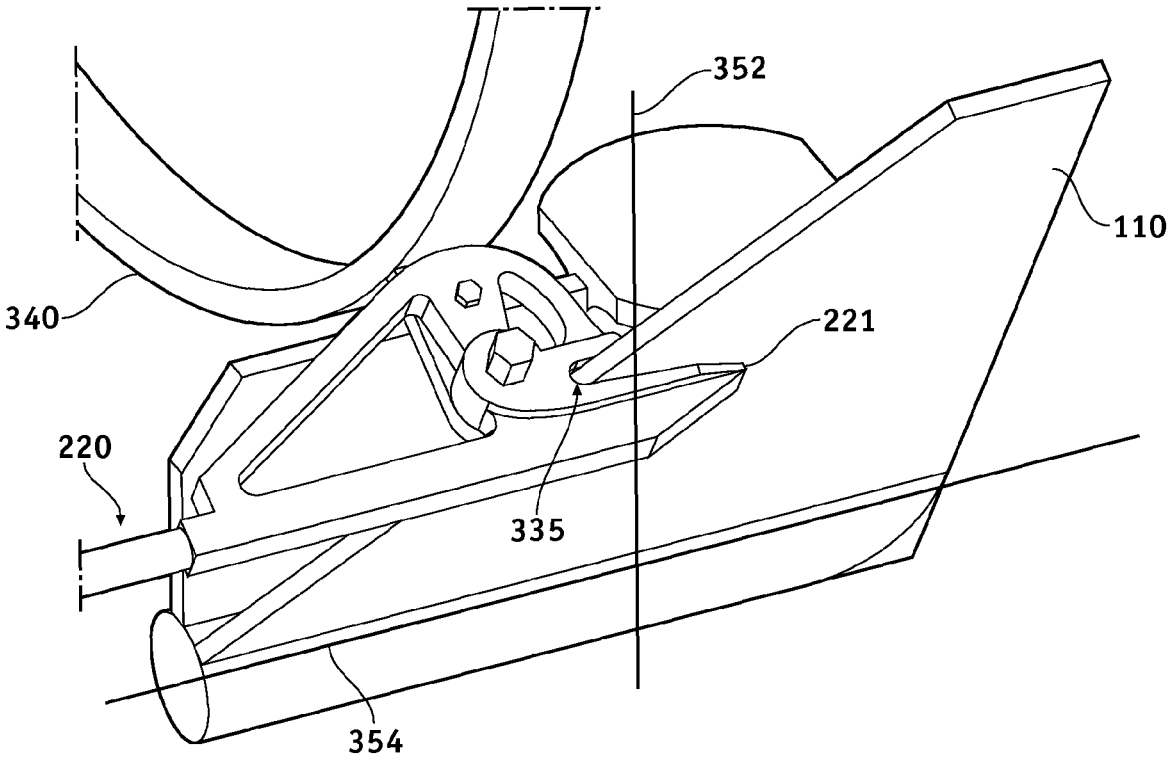
Figure 4A:
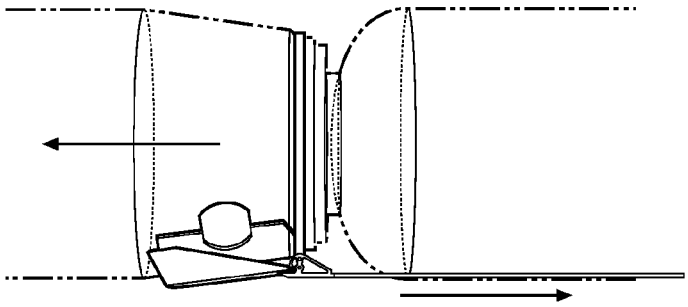
FIG. 4 representatively illustrates a sequential series of the restraint apparatus detaching from the control surface, according to the embodiment.
Figure 4B:
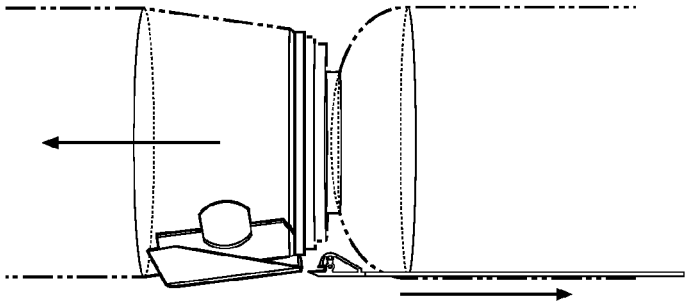
Figure 4C:
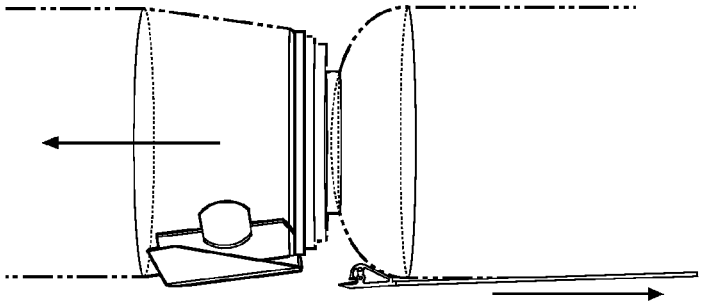
Figure 4D:
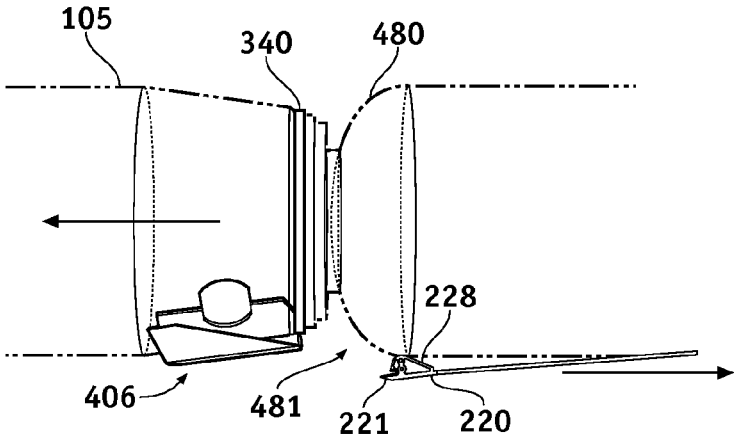

For example, various representative implementations of the present invention may be applied to any appropriate device for missile launch systems. A detailed description of an exemplary application, namely a restraint and release system, is provided as a specific enabling disclosure that may be generalized to any application of the disclosed system, device, and method for restraint and/or release of longitudinal propulsion systems and the like in accordance with various embodiments of the present invention Referring to FIG. 1, a restraint and release system 100 according to various aspects of the present invention for a control surface 110 of a projectile 105 may comprise a restraint apparatus 220 detachably coupled to the control surface 110 and a stopping mechanism (not shown) configured to stop a movement of the restraint apparatus 220. The restraint and release system 100 may further comprise a guidance rail 130 slidably engaged to the restraint apparatus 220, and the stopping mechanism may be coupled to the guidance rail 130. Referring to FIGS. 3A-B, the restraint and release system 100 may further comprise a projectile interface 340 that may couple to the restraint apparatus 220 by a breakable tab 350. The restraint and release system 100 may also comprise a projectile suspension system 160 that may engage an enclosure 170 and may also support the projectile 105 within the enclosure 170. In one embodiment, the restraint and release system 100 may be substantially housed within the enclosure 170.

Figure 1:
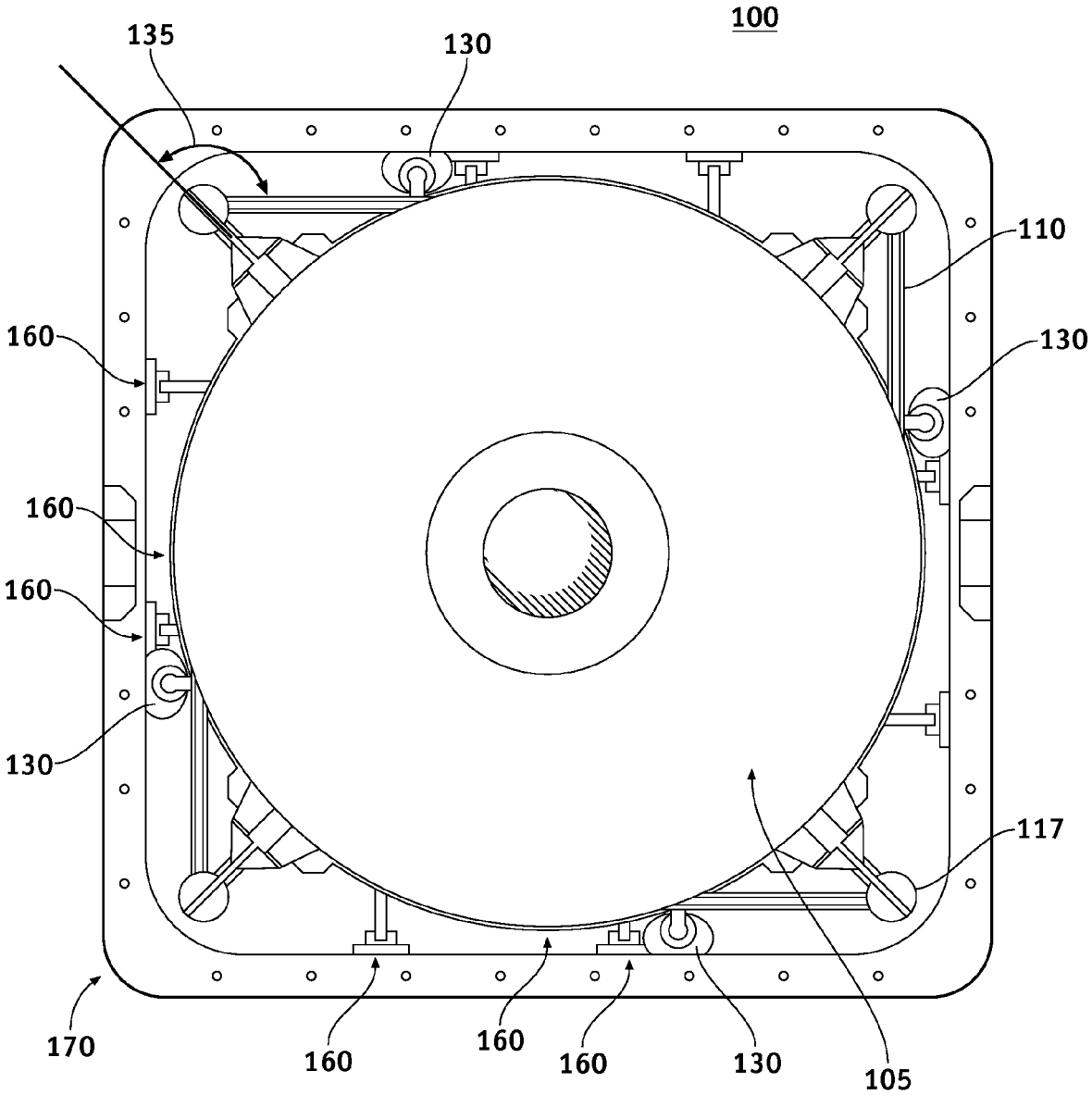
FIG. 1 representatively illustrates a front, end-on view of a missile stowed within an enclosure, according to an embodiment of a method and apparatus for control surface restraint and release system.
Figure 2:
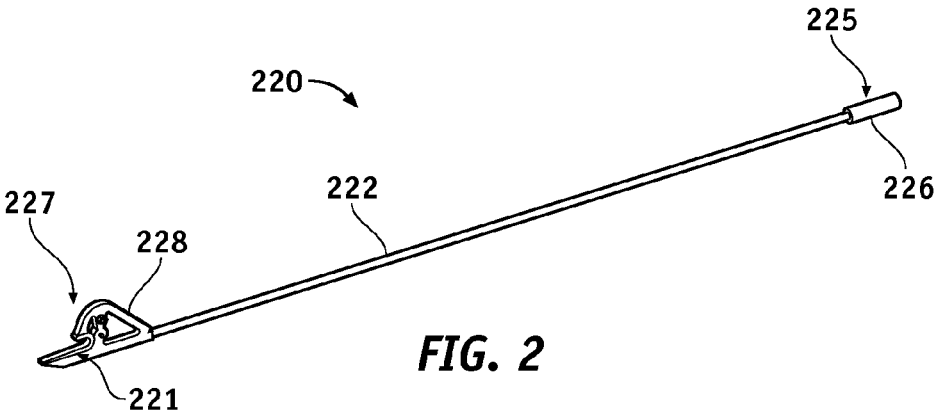
FIG. 2 representatively illustrates a restraint apparatus, according to the embodiment.

Among various embodiments, the enclosure 170 may comprise an enclosure such as a canister, box, tube, and the like to enclose a projectile 105 and the various support mechanisms. Referring to FIG. 1, the projectile 105 may be positioned within the enclosure 170 such that the control surfaces 110, in a stowed position, may be positioned in one or more corners of the enclosure 170. The stowed position of the control surfaces 110 may be any position for storage before launch, such as folded configuration to reduce the maximum span of the projectile 105. In one embodiment, the control surface 110 may comprise a stabilizing fin for the projectile 105, and the restraint apparatus 220 positions the control surfaces 110 at a fold angle 135. In one embodiment, the fold angle 135 comprises an angle of about 133.5°, but may range from about 125° to about 145°. The fold angle may, however, comprise any suitable angle for folding the fins. In addition, the restraint apparatus 220 may be adapted to other types of deployable elements, such as radially deployable tins, portal covers, arming mechanisms, or other elements of the projectile 105.

The restraint apparatus 220 may assist in securing the control surfaces 110 and/or the projectile 105 in place, such as to restrain the control surfaces 110 and/or the projectile 105 from excessive movement within the enclosure 170. The restraint apparatus 220 may comprise any suitable mechanism, such as a fork 221, for exerting a restraining force on the control surface 110 to maintain the control surface 110 in position. For example, the restraint apparatus 220 may comprise an elongated rod 222 of solid or tubular construction, and one end 225 of the elongated rod 222 may comprise an end stop 226, such as an index key, suitable for maintaining a desired position of the restraint apparatus 220. A second end 227 may comprise the fork 221 that restrains the control surface 110. Among various embodiments, the restraint apparatus 220 may be configured to couple to the control surface 110 in any suitable manner. For example, instead of a fork 221, the restraint apparatus 220 may couple to control surface 110 by pins, hooks, clamps, adhesives, snaps, Velcro®, friction fits and/or any other mechanism that may detachably couple restraint apparatus 220 to control surface 110.

For example, referring to FIG. 3B, the fork 221 may be configured to secure and/or crutch the control surface 110 to restrain the control surface 110 about both a hinge axis 352 and a fold axis 354. In this embodiment, the fork 221 crutches the leading edge 335 of the control surface 110 about the hinge axis 352, thus securing the control surface in a substantially zero degree state. The control surface 110 may be restrained about any referential axis at various angles.

In the present embodiment, referring to FIG. 4, the fork 221 may comprise a deflection ramp 228 for deflection by a forward portion 481 of a booster 480, and the booster 480 may be coupled to an aft portion 406 of the projectile 105. The fork 221 and/or the ramp 228 of the restraint apparatus 220 may comprise a friction-reducing surface, such as Teflon®, to control friction between the fork 221 and the control surface 110, and/or the ramp 228 and the booster 480.

Figure 5:
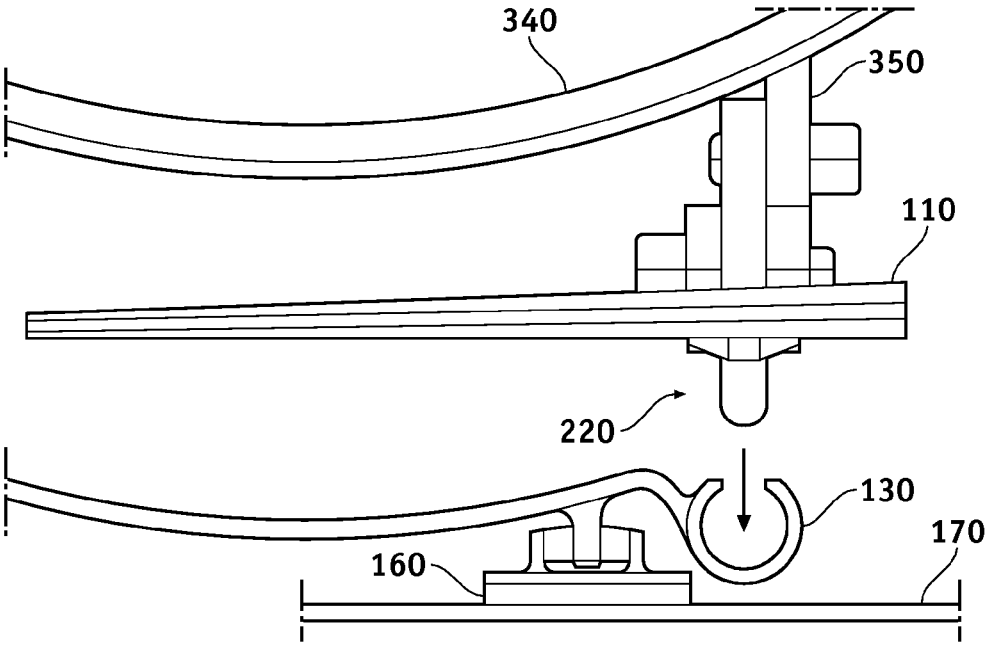
FIG. 5 representatively illustrates a guidance rail engaging the restraint apparatus, according to the embodiment.
Figure 6:
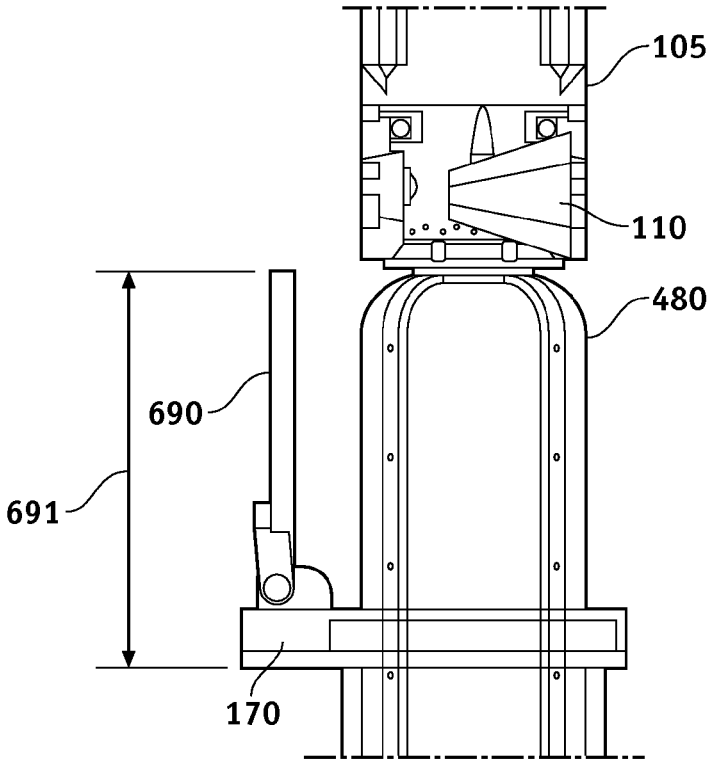
FIG. 6 representatively illustrates a projectile during launch from the enclosure, according to the embodiment.

In one embodiment, the restraint apparatus 220 may be configured to restrain the control surface 110 from rotating within the enclosure 170. Referring to FIG. 5, the restraint apparatus 220 may be slidably engaged within the guidance rail 130. With the restraint apparatus 220 engaged by guidance rail 130, the restraint apparatus 220 does not effectively rotate, but may restraint apparatus 220 slide along the longitudinal axis of the guidance rail 130. This configuration helps stabilize projectile 105 as projectile 105 is stowed within enclosure 170. Moreover, referring to FIGS. 3(*a*) and 3(*b*), this configuration further allows the restraint apparatus 220 to secure the control surface 110 in a substantially fixed position until the control surface 110 clears an exterior obstacle, such as a hatch 690.

In another embodiment, the restraint apparatus 220 may comprise an elongated cable (not shown) instead of the elongated rod 222. One end of the elongated cable may comprise the end stop, such as the index key 226 or other mechanism for limiting the travel of the restraint apparatus 220, such as a tether point to the enclosure 170. The second end may comprise the fork 221 or other appropriate mechanism to restrain the control surface 110, such as at the hinge and/or fold axis 354.

Among the various embodiments, the end stop 226 of the restraint apparatus 220 may be configured to engage one end of the guidance rail 130. The length of the restraint apparatus 220 may be at least a length 691 of the hatch 690 or any other obstacle to be cleared.

Referring to FIGS. 3A-B, the restraint apparatus 220 may be implemented in conjunction with the projectile interface 340, and the projectile interface 340 may couple the restraint apparatus 220 to the projectile 105. The projectile interface 340 may be coupled to the projectile 105 and detachably coupled to the restraint apparatus 220 by the breakable tab 350. In the present embodiment, the projectile interface 340 may be coupled via the breakable tab 350 to the restraint apparatus 220, such as via a brittle metal, plastic, ceramic, or any other connector that may allow projectile interface 340 to separate or "break" from restraint apparatus 220. For example, a fracture plane (not shown) on the breakable tab 350 may be defined or created by notching the breakable tab 350 or by using any other appropriate mechanism for defining a breaking point.

The projectile interface 340 may comprise any component or system for coupling the restraint apparatus 220 and the projectile 105, such as a ring 340 around the projectile 105. The projectile interface 340 may comprise a separate apparatus or may be mounted to any hard point directly on the projectile 105. In the present embodiment, the projectile interface 340 may comprise the ring 340 around the aft end 406 of the projectile 105, but forward of the booster 480. In various embodiments, other configurations of projectile interfaces may used to couple the restraint apparatus 220 to the projectile 105.

Referring again to FIG. 1, the restraint apparatus 220 may be implemented in conjunction with the guidance rail 130. The guidance rail 130 may be proximate to the interior surface of the enclosure 170. The guidance rail 130 facilitates the movement of the restraint apparatus 220 along with the projectile 105, yet inhibits rotation of the projectile 105.

Figure 7:
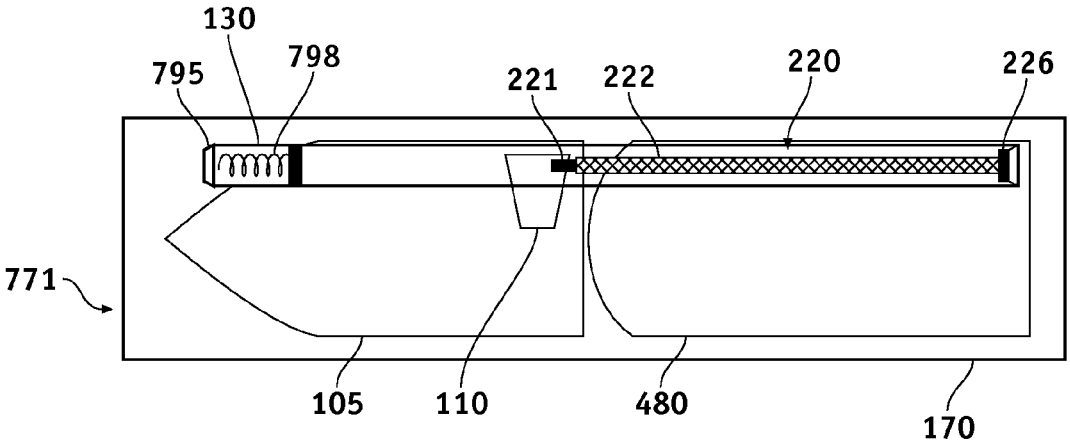
FIG. 7 representatively illustrates a longitudinal cross section of the control surface restraint and release system, according to the embodiment.
Figure 8:
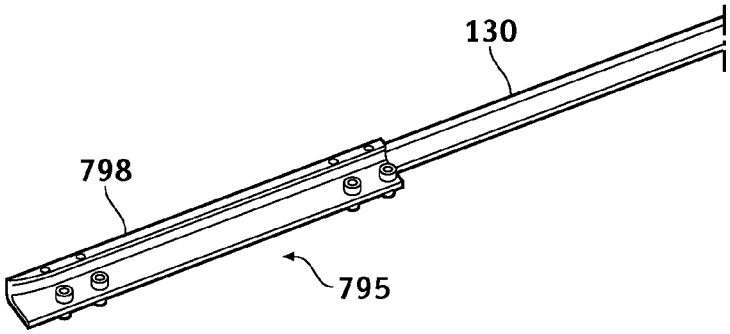
FIG. 8 representatively illustrates a deceleration rebound spring as part of the control surface restraint and release system, according to the embodiment.

Referring to FIGS. 7 and 8, the guidance rail 130 may comprise a stopping mechanism 795. In one embodiment, lateral and rotational motion of the projectile 105 may be limited by clearance between the sides of the restraint apparatus 220 engaged within the guidance rail 130. The restraint apparatus 220 may slidably engage the guidance rail 130 and respond to a force applied by the stopping mechanism 795. In the present embodiment, the stopping mechanism 795 may comprise a deceleration rebound spring 798 that in one embodiment may be coupled to the end of the guidance rail 130, but in another embodiment deceleration rebound spring 798 may also reside within guidance rail 130.

For example, a portion of the restraint apparatus 220 may be configured to slide along the guidance rail 130 upon deployment of the projectile 105, and the restraint apparatus 220 may stop upon engaging the rebound spring 798 of stopping mechanism 795 at a launch end 771 of the enclosure 170. More particularly, the shaft 222 of the restraint apparatus 220 slidably engages the guidance rail 130. The deceleration rebound spring 798 responds to force applied by some portion of the restraint apparatus 220. For example, the deceleration rebound spring 798 may respond to a force applied by the end stop 226 of the restraint apparatus 220. The deceleration rebound spring 798 allows the fork 221 and shaft 222 of the restraint apparatus 220 to pass but prevents the end stop 226 from passing.

The deceleration rebound spring 798 may comprise any suitable spring for decelerating and/or stopping the restraint apparatus 220. For example, the spring material and spring constant may be selected based upon the desired distance of restraint and length of the deceleration stroke prior to release of the control surface 110. In one embodiment, a deceleration rebound spring 798 is a U-shaped polyurethane die spring. In another embodiment, the guidance rail 130 may restrain the projectile's angular orientation with respect to the enclosure 170. Additionally, the end stop 226 may also be configured in any suitable manner to provide anti-rotation of the projectile 105 and aid in the alignment of projectile 105.

Figure 9:
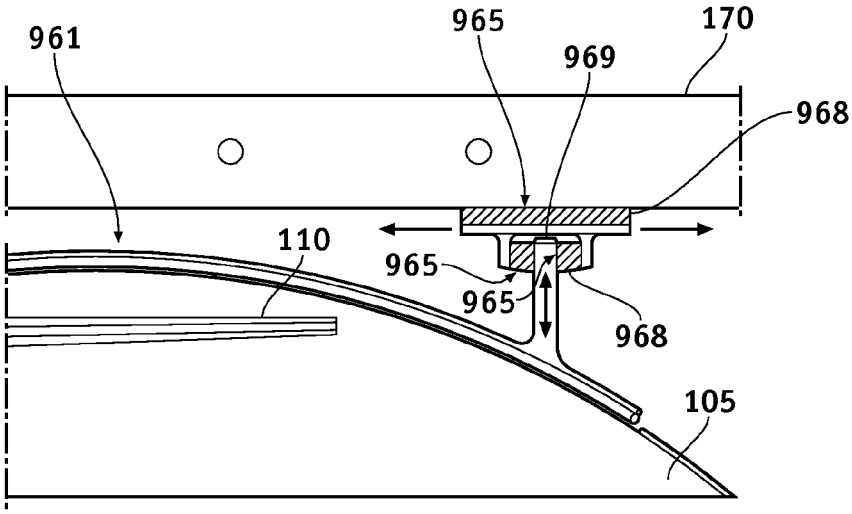
FIG. 9 representatively illustrates a suspension system, according to the embodiment.

The restraint and release system 100 may be implemented in conjunction with a suspension system 160 to provide an interface between the enclosure 170 and the projectile 105 in any suitable manner. The suspension system 160 may be configured to support the projectile 105 during storage, transport, deployment and/or egression. Referring to FIG. 9, the suspension system 160 may comprise one or more supports 961 and one or more shock mounts 965. The support 961 may substantially conform to the exterior surface body of the projectile 105 and may couple the projectile 105 to the enclosure 170 via the shock mounts 965. The support 961 may be configured in any suitable manner to interface with the projectile 105 according to properties of the projectile, such as weight and/or dimensions. In one embodiment, the support 961 may comprise a thin curved profile for radial support of the projectile 105.

Among various embodiments, the support 961 may be comprised of any suitable material to support the load of the projectile 105, such as anodized aluminum, composites, and the like. In one embodiment, the support 961 may comprise or be coated with a low friction material, such as polytetrofluroethylene, i.e. Teflon®. In the present embodiment, the support 961 may comprise about a 1.25 inch thick anodized aluminum configuration, but other thicknesses and materials may be used. In an alternative embodiment, the support 961 may comprise of a softer material to achieve a desired weight-to-stiffness ratio to provide a more "hammock"-like support for the projectile 105. The support 961 may extend the length of the enclosure 170 or any other length suitable to provide support to the projectile 105.

The shock mounts 965 may couple the support 961 to the enclosure 170 to further secure projectile 105 within enclosure 170. In one embodiment, at least a portion of shock mounts 965 may comprise a high density elastomeric material 968 to absorb shock and movement of the projectile during storage, transport, launch, etc. The shock mounts 965 may also comprise stop 969, such as a hard rubber to limit movement in one direction. The shock mounts 965 configuration shown is merely one exemplary embodiment, and many other configurations and materials that may absorb shock, limit movement of the projectile 105, and couple the support 961 to the enclosure 170 may be used.

Figure 10:
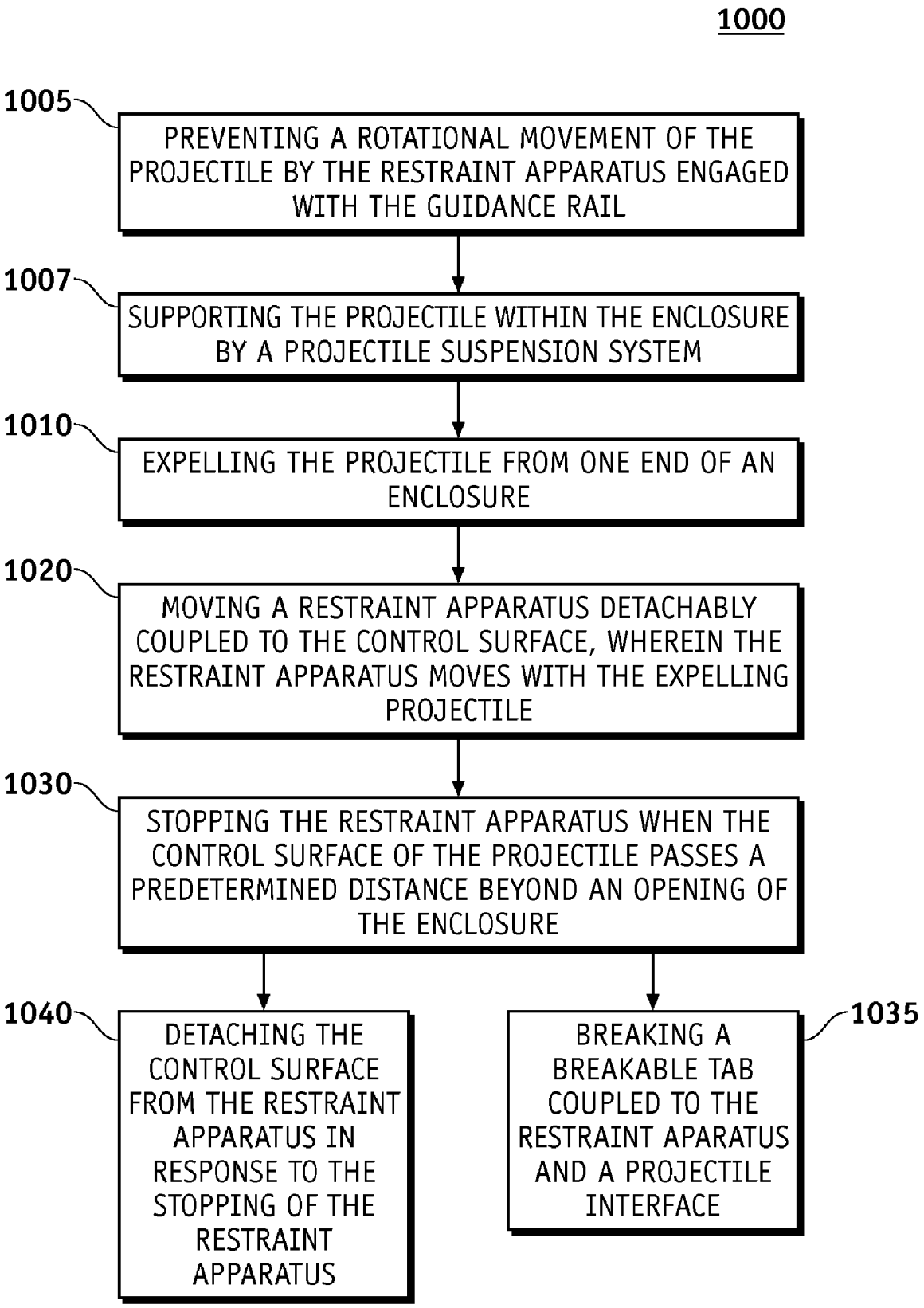
FIG. 10 representatively illustrates a flow chart of a method, according to an embodiment for a method and apparatus for a control surface restraint and release system.

In operation, referring to FIG. 10, restraining and releasing the control surface of the projectile may comprise expelling the projectile from one end of the enclosure (1010); moving a restraint apparatus detachably coupled to the control surface, wherein the restraint apparatus moves with the expelling projectile (1020); stopping the restraint apparatus when the control surface of the projectile passes a predetermined distance beyond an opening of the enclosure (1030); and detaching the control surface from the restraint apparatus in response to the stopping of the restraint apparatus (1040).

In an embodiment of the method, the method (1000) may further comprise, before expelling the projectile, preventing a rotational movement of the projectile by the restraint apparatus engaged with the guidance rail (1005). Also before expelling the projectile, an embodiment of method (1000) may further comprise supporting the projectile within the enclosure by a projectile suspension system (1007).

In an embodiment, the method (1000) may also comprise stopping the restraint apparatus (1030) and breaking of a breakable tab coupled to the restraint apparatus and a projectile interface (1035).

Among various method embodiments, moving the restraint apparatus may comprise moving the restraint apparatus slidably along a guidance rail, expelling the projectile, such as by launching a missile, and/or extending the guidance rail substantially along an inner surface of the enclosure In one exemplary method embodiment, the restraint and release system 100 is configured with the restraint apparatus 220 fully retracted within guidance rail 330 along the inside surface of the enclosure 170. As the missile 105 launches, the movement exerts force upon the projectile interface 340 which in turn exerts force on the restraint apparatus 220. The restraint apparatus 220 travels along the guidance rail 330 coincidentally with the missile 105 as the missile 105 is launched or otherwise expelled from the enclosure 170. In one embodiment, the restraint apparatus 220 braces the control surface 110 about the control surface's hinge axis 352, preventing rotation of the missile 105 during movement and front cover push through of the enclosure hatch 690.

Once the restraint apparatus 220 reaches the end of the guidance rail 330, i.e. the restraint apparatus stroke, the end stop 226 of the restraint apparatus 220 engages the deceleration rebound spring 798 and the restraint apparatus 220 begins the deceleration stroke. At the end of the deceleration stroke the deceleration rebound spring 798 reaches full compression and the restraint apparatus 220 stops, thereby ceasing to travel with the missile 105, and causing the breaking tab 350 between the projectile interface 340 and the restraint apparatus 220 to break. As the missile 105 clears the hatch 690 of the enclosure 170, the control surface 110 is detached from the fork 221 of the restraint apparatus 220, thus allowing the control surface 110 to unfold in full deployment under spring force. The restraint and release system 100 may, however, perform any appropriate process to delay release of the control surface 110 until the control surface 110 has cleared the top of the hatch 690 and/or any desired obstacle. Once the restraint apparatus 220 detaches from the control surface 110, the restraint apparatus 220 may be disposed of in any suitable manner, such as falling off the end of the enclosure 170, retracting back into the enclosure 170, or be physically removed from the end of the enclosure 170 after launch. The index key 226 may maintain angular orientation of the restraint apparatus 220 to the guidance rail 130 during use and/or retraction into the enclosure 170.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention.

Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition, system, or apparatus that comprises a list of elements does not include only those elements recited, but may also include other elements not expressly listed or inherent to such process, method, article, composition, system or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

What is claimed is:

1. A restraint and release system for a control surface of a projectile, comprising:

an elongated restraint apparatus detachably coupleable to the control surface, wherein the control surface is actuatable to effect a change in airflow around the projectile and the elongated restraint apparatus is elongated in a deployment direction of the projectile; and a stopping mechanism coupled to the elongated restraint apparatus and configured to stop a movement of the elongated restraint apparatus;

a projectile interface, wherein the projectile interface couples to the elongated restraint apparatus by a breakable tab.

2. The restraint and release system according to claim 1, further comprising a guidance rail slideably engaging the elongated restraint apparatus.

3. The restraint and release system according to claim 1, further comprising a projectile suspension system, wherein the projectile suspension system engages an enclosure and is adapted to support the projectile within the enclosure.

4. The restraint and release system according to claim 1, wherein the elongated restraint apparatus comprises at least one of a fork, a shaft, an index key, and an end stop.

5. The restraint and release system according to claim 1, wherein a guidance rail is adapted to inhibit a rotation of the projectile within an enclosure.

6. The restraint and release system according to claim 1, wherein the stopping mechanism comprises a deceleration rebound spring.

7. The restraint and release system according to claim 1, wherein the control surface comprises a fin of the projectile.

8. The restraint and release system according to claim 7, wherein the projectile comprises a missile.

9. A restraint and release system for a control surface of a projectile substantially within an enclosure, comprising:

a projectile interface coupleable to the projectile;

an elongated restraint apparatus coupled to the projectile interface by a breakable tab, wherein the elongated restraint apparatus is detachably coupleable to a control surface of the projectile, wherein the control surface is actuatable to effect a change in airflow around the projectile and the elongated restraint apparatus is elongated in a deployment direction of the projectile;

a guidance rail slideably engaging the elongated restraint apparatus;

a stopping mechanism coupled to the guidance rail and configured to stop a movement of the elongated restraint apparatus; and a projectile suspension system configured to engage an enclosure and support the projectile within the enclosure.

10. The restraint and release system according to claim 9, wherein the suspension system couples to the guidance rail.

11. The restraint and release system according to claim 9, wherein the suspension system further comprises at least one of one or more supports and one or more shock mounts.

12. The restraint and release system according to claim 11, wherein the one or more shock mounts is adapted to couple the projectile to the enclosure and the supports are adapted to support the projectile.

13. The restraint and release system according to claim 12, wherein the support comprises at least one of polytetrafluoroethylene, an anodized aluminum, and a composite.

14. A method of restraining and releasing a control surface of a projectile, comprising:

expelling the projectile from one end of an enclosure;

moving an elongated restraint apparatus detachably coupled to the control surface, wherein the control surface is actuatable to effect a change in airflow around the projectile, wherein the elongated restraint apparatus moves with the expelling projectile and the elongated restraint apparatus is elongated in a direction in which the projectile is expelled;

stopping the elongated restraint apparatus when the control surface of the projectile passes a predetermined distance beyond an opening of the enclosure; and detaching the control surface from the elongated restraint apparatus in response to the stopping of the restraint apparatus.

15. The method according to claim 14, wherein stopping the elongated restraint apparatus causes a breaking of a breakable tab coupled to the restraint apparatus and a projectile interface.

16. The method according to claim 14, wherein moving the restraint apparatus comprises moving the elongated restraint apparatus slideably along a guidance rail.

17. The method according to claim 16, further comprising, before expelling the projectile, preventing a rotational movement of the projectile by the elongated restraint apparatus engaged with the guidance rail.

18. The method according to claim 17, wherein the guidance rail extends substantially along an inner surface of the enclosure.

19. The method according to claim 14, further comprising, before expelling the projectile, supporting the projectile within the enclosure by a projectile suspension system.

* * * * *